United States Patent [19]

Kronbetter

[11] Patent Number: 5,028,082

[45] Date of Patent: Jul. 2, 1991

[54] LATCHING MECHANISM FOR SLIDING MEMBERS

[75] Inventor: Clarence W. Kronbetter, St. Joseph, Mich.

[73] Assignee: Chardon Rubber Company, Chardon, Ohio

[21] Appl. No.: 554,023

[22] Filed: Jul. 17, 1990

[51] Int. Cl.[5] ..... E05B 17/02

[52] U.S. Cl. ..... 292/128; 292/254; 292/DIG. 21; 292/DIG. 47; 49/483; 49/370

[58] Field of Search ..... 292/254, DIG. 21, DIG. 46, 292/DIG. 47, 219, 228, 121, 128; 49/486, 488, 406, 458, 483, 366, 368, 367, 370; 296/166, 155, 917

[56] References Cited

U.S. PATENT DOCUMENTS

| | | | |
|---|---|---|---|
| 1,193,000 | 8/1916 | Edwards | 292/128 |
| 3,161,923 | 12/1964 | Crain | 292/DIG. 46 |
| 3,181,905 | 5/1964 | Bisbing | 292/109 |
| 3,881,758 | 5/1975 | Gross | 292/128 |
| 3,893,261 | 7/1975 | Cribben | 292/DIG. 46 |
| 4,106,239 | 8/1978 | Bancroft et al. | 292/DIG. 46 |
| 4,124,054 | 11/1978 | Spretnjak | 296/166 |
| 4,202,136 | 5/1980 | Riegelman | 49/370 |
| 4,322,914 | 4/1982 | McGaughey | 49/370 |
| 4,395,847 | 8/1983 | Atchison | 49/406 |
| 4,635,398 | 1/1987 | Nakamura | 49/370 |

FOREIGN PATENT DOCUMENTS

| | | | |
|---|---|---|---|
| 0342137 | 11/1989 | European Pat. Off. | 70/95 |
| 911376 | 5/1954 | Fed. Rep. of Germany | 49/483 |

*Primary Examiner*—Eric K. Nicholson
*Assistant Examiner*—Darnell M. Boucher
*Attorney, Agent, or Firm*—Renner, Kenner, Greive, Bobak, Taylor & Weber

[57] ABSTRACT

A latching mechanism (10) for automatically locking, and selectively unlocking, opposed first and second sliding members (11A and 11B). The latching mechanism (10) has first and second latch subassemblies (45 and 50). The first latch subassembly (45) is adapted to be secured to one sliding member (11A), and the second latch subassembly (50) is adapted to be secured to a second sliding member (11B). A catch block (75) is presented from the first latch subassembly (45). The catch block (70) has a cam portion (76) and a locking portion (80). The first latch subassembly (45) has a pivotally mounted first release lever (65), and the second latch subassembly (50) has a pivotally mounted second release lever (95). A latch arm (106) is presented from the second release lever (95) to engage a cam portion (76) when the sliding members (11A and 11B) are closing and to engage the locking portion (80) to lock with sliding members (11A and 11B) in their closed position. The work arm (69) and the throw arm (105) interact between the first and second release levers (65 and 95) so that pivotal movement of either release lever (65 or 95) will release a latch arm (106) from a locking surface (80).

15 Claims, 4 Drawing Sheets

LATCHING MECHANISM FOR SLIDING MEMBERS

TECHNICAL FIELD

The present invention relates generally to latching systems. More particularly, the present invention relates to an improved latching mechanism for use with relatively slidable members. Specifically, the present invention relates to a latching mechanism which will automatically lock when the sliding members are closed, and which may be unlocked by conveniently manipulating, with one hand, only that portion of the latching mechanism supported from the relatively slidable member to be opened.

BACKGROUND OF THE INVENTION

A number of different mechanical arrangements have been employed to lock and unlock relatively slidable members. Arrangements have been developed for use with members that slide in parallel planes, and distinct arrangements have been developed for use with members that slide in a common plane, but all prior known arrangements tend to require at least two, and sometimes three, separate and distinct operations to unlatch and open one of the slidable members. That is, the prior art latching arrangements must first be unlocked, and then the members must be slid apart independently of the unlatching operation. Typically, with one prior known arrangement, one sliding member must always be opened at least a modest amount before the other sliding member can be opened at all.

One of the most successful prior latching arrangements has a keeper affixed to one sliding member, and a second, one-piece, articulating latching member affixed to the other sliding member. The latching member is comprised of three segments—viz.: a base, by which the latching member is secured to the sliding member from which it is presented; a keeper engaging latch; and, a hinge plate which is interposed between the base and the keeper engaging latch and which is connected to each by living hinges, one at each end of the hinge plate. When the base on the latching member and the separate keeper are properly affixed to the opposed slidable members, the base and keeper are coplanar and are disposed in opposition. Thus, when the sliding members are closed, the latch may be swung over the keeper, brought into mating engagement therewith and then pivoted about the keeper in an over-center locking movement accommodated by the hinge plate. This latching mechanism can be unlocked by retro-rotation of the latch. Such an arrangement is described in detail in U.S. Pat. No. 3,181,905.

The aforesaid latching mechanism operates quite well. However, in order to open the sliding members to which it is attached, the latching mechanism must first be unlatched, and thereafter the sliding member that is to be opened must be grasped and slid open. Typically, one would grasp the latch and use it as a handle to slide that member, or one would attempt to engage the keeper with a finger to slide the other member. With the sliding members closed it is sometimes inconvenient, if not impossible, to engage the keeper so that one normally opens that member to which the latch is attached, slides it a short distance and then applies a hand against the other member to open it.

Thus, even one of the most successful latching mechanisms, as disclosed in the aforesaid U.S. Pat. No. 3,181,905, requires two separate operations to open, or close, the sliding members. Moreover, a third operation may be required to open that sliding member to which the keeper is secured. In any event, this operation requires visual attention and at least modest manual dexterity, particularly if the person attempting to use the latching mechanism is normally facing away from the latching mechanism—as would be the situation when the latching mechanism is employed in conjunction with the sliding windows employed at the rear of a truck cab. It should also be noted that living hinges have a limited life so that it is generally necessary to replace the prior art latching member from time to time.

SUMMARY OF THE INVENTION

It is, therefore, a primary object of the present invention to provide a latching mechanism for opposed slidable members which can be unlocked, and opened, in one continuous operation—and with only one hand.

It is another object of the present invention to provide an improved latching mechanism, as above, in which an individual latch subassembly is affixed to each of the two opposed sliding members, the subassemblies permitting the selective opening of either of the two opposed sliding members merely by manipulation of that latch subassembly attached to the sliding member to be opened.

It is a further object of the present invention to provide an improved latching mechanism, as above, which automatically locks when the opposed slidable members are closed.

It is yet another object of the present invention to provide an improved latching mechanism, as above, which is not subject to failure as a result of cyclic operations.

These and other objects of the invention, as well as the advantages thereof over existing and prior art forms, which will be apparent in view of the following detailed specification, are accomplished by means hereinafter described and claimed.

In general, a latching system embodying the concepts of the present invention allows an operator to effect the opening of either of two opposed and slidable members by manipulating only that portion of the latching mechanism attached to the slidable member to be opened. In an exemplary embodiment of the invention, a latching mechanism is provided for automatically locking, and selectively unlocking opposed first and second slidable members, preferably the rear windows of a truck cab. The latching mechanism has first and second latch subassemblies. The first latch subassembly is adapted to be secured to one slidable member, and the second latch subassembly is adapted to be secured to the other slidable member. A catch block is presented from the first latch subassembly. The catch block has a cam portion and a locking portion. The first latch subassembly has a pivotally mounted first release lever, and the second latch subassembly has a pivotally mounted second release lever. A latch arm is presented from the second release lever to engage said cam portion when said sliding members are closing and to engage said locking portion to lock said sliding members in their closed position. Means are interactive between the first and second release levers so that pivotal movement of either will release the latch arm from the locking surface.

A detailed description of the aforesaid, exemplary embodiment is deemed sufficient to effect a full disclosure of the subject invention, the exemplary embodiment being shown by way of example in the accompanying drawings and being described in detail without attempting to show all the various forms and modifications in which the invention might be embodied. In that regard it should be understood that the invention is measured by the appended claims and not by the details of the specification.

DESCRIPTION OF AN EXEMPLARY EMBODIMENT

Figure 1:
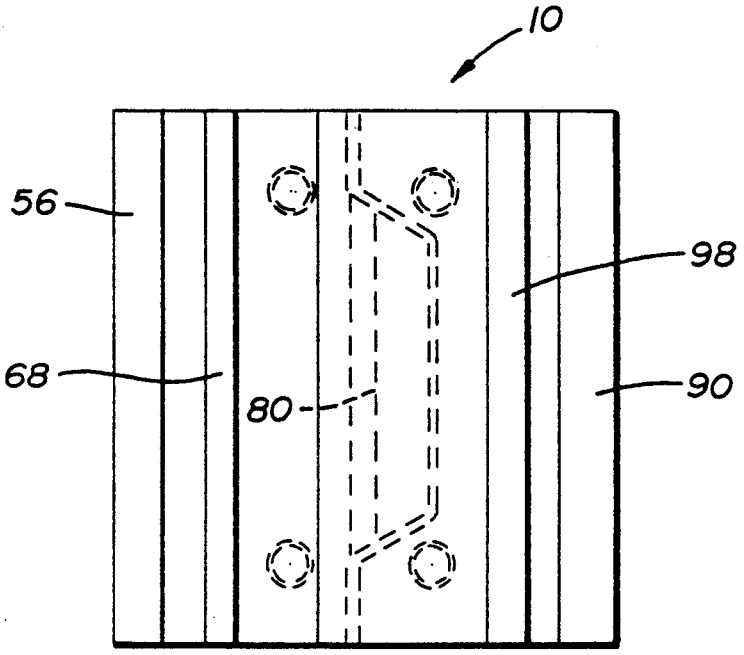
FIG. 1 is a plan view an exemplary latching mechanism embodying the concepts of the present invention and depicted in the locked position.
Figure 2:
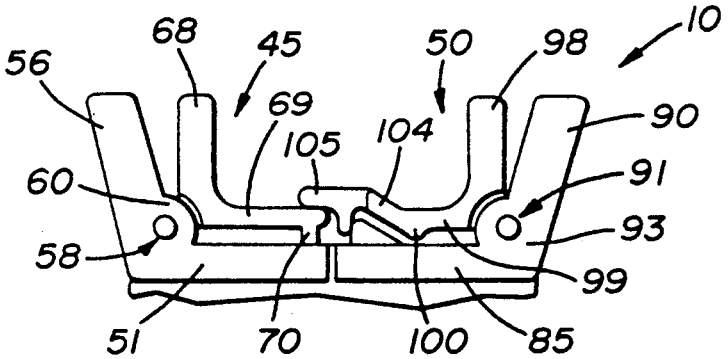
FIG. 2 is an end elevation of the latching mechanism depicted in FIG. 1.
Figure 3:
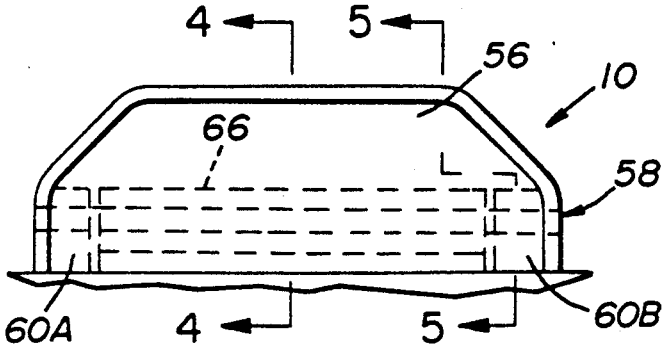
FIG. 3 is a side elevation of the latching mechanism depicted in FIG. 1.

An exemplary form of a latching mechanism embodying the concepts of the present invention designated by the identifying numeral 10 on the attached drawings. The latching mechanism 10 has particular applicability for use in conjunction with coplanar, sliding members such as doors, windows and the like. Because the latching mechanism 10 has particular adaptability for use with coplanar sliding windows of the type often employed as the rear window for the cab of a truck or the like, the latching mechanism 10 will be described as operatively employed with a pair of window units 11A and 11B, as depicted with greater detail in FIGS. 4 and 5.

Each window unit 11A and 11B includes a rectangular pane of glass 12 that is circumscribed by a frame 13. The elements of the frame 13 which are employed along three sides of the pane 12 are well known to the art for providing the necessary seal between the pane and the adjacent supporting structure as well as for facilitating the sliding movement of the window units 11A and 11B. As such, they need not, and will not, be described herein. The fourth element 14 of each frame 13, however, will be described inasmuch as the latch mechanism 10 is operatively secured between opposed frame elements 14A and 14B presented, respectively, from the window units 11A and 11B.

In the detailed description which follows, a particular structural member, component or arrangement may be employed at more than one location. When referring generally to that type of structural member, component or arrangment a common numerical designation shall be employed. However, when one of the structural members, components or arrangements so identified is to be individually identified it shall be referenced by virtue of a letter suffix employed in combination with the numerical designation employed for general identification of that structural member, component or arrangement. Thus, there are at least two frame elements which are generally identified by the numeral 14, but the specific, individual frame elements are, therefore, identified as 14A and 14B in the specification and on the drawings. This same suffix convention shall be employed throughout the specification.

Each frame element 14 has a transverse wall 15 which forms the base of a pane receiving channel 16, the opposed, substantially parallel legs 18 and 19 of which embrace one edge portion 20 of the pane 12. A plurality of gripper ridges 21 extend along the oppose legs 18 and 19 to contact the opposite surfaces 22 and 23 of the pane 12. A suitable adhesive, not shown, may be applied between the ridges 21 and the surfaces 22 and 23 engaged thereby in order to insure that the frame element 14 is fixedly secured to its pane 12.

A compression sealing arrangement 25A is presented from the transverse wall 15A of the frame element 14A to interact with an opposed, but reversed, sealing arrangement 25B presented from the transverse wall 15B of the frame element 14B.

The compression sealing arrangement 25A has a sealing wall 26 which extends outwardly from the transverse wall 15A in a direction opposite to leg 18A of the pane receiving channel 16A. The sealing wall 26 terminates in a transverse, spacing face 28 which joins with an inclined sealing face 29 and locates the sealing face 29 for engagement with the sealing arrangement 25B, as hereinafter explained.

An extension wall 30 also extends outwardly from the transverse wall 15A but in a direction opposite to leg 19A of the pane receiving channel 16A. The extension wall 30 is spaced laterally of the sealing wall 26 and terminates in a laterally offset, first sealing rib 31. The first sealing rib 31 is generally triangular in cross-section to present a pair of compression walls 32 and 33 which diverge laterally outwardly from the rounded apex 34 of the first sealing rib 31.

The compression sealing arrangement 25B has an extension wall 35 which extends outwardly from the transverse wall 15B in a direction opposite to the leg 18B of the pane receiving channel 16B and terminates in a laterally offset, second sealing rib 36. The second sealing rib 36 is also generally triangular in cross-section to present a pair of compression walls 38 and 39 which diverge laterally outwardly from the rounded apex 40. The compression sealing arrangement 25B also has a sealing wall 41 which terminates in a transverse spacing face 42 that joins with an inclined sealing face 43 and locates the sealing face 43 for engagement with the sealing arrangement 25A, as will now be explained. The sealing wall 41 is also spaced laterally of the extension wall 35.

The relative dimensions of the components which form the sealing arrangements 25A and 25B are such that when the window units 11A and 11B are slid into contiguous juxtaposition the sealing ribs 31 and 36 will wedge against each other and also between the sealing walls 26 and 41 in the position determined by the transverse extent of the spacing faces 28 and 42. Specifically, the inclined compression walls 32 and 38 on the sealing ribs 31 and 36, respectively, will engage each other to drive the inclined compression wall 33 on rib 31 against the sealing face 43 on the sealing wall 41 as well as to drive the inclined compression wall 39 on the rib 36 against the sealing face 29 on sealing wall 26. The aforesaid interaction of the sealing arrangements of 25A and 25B effects a weather-tight seal between the opposed frame elements 14A and 14B when brought into contiguous juxtaposition.

The latching mechanism 10 utilizes first and second latch subassemblies 45 and 50. Latch subassembly 45 is mounted on the frame element 14A included in window unit 11A, and subassembly 50 is mounted on the frame element 14B included in window unit 11B.

Figure 6:
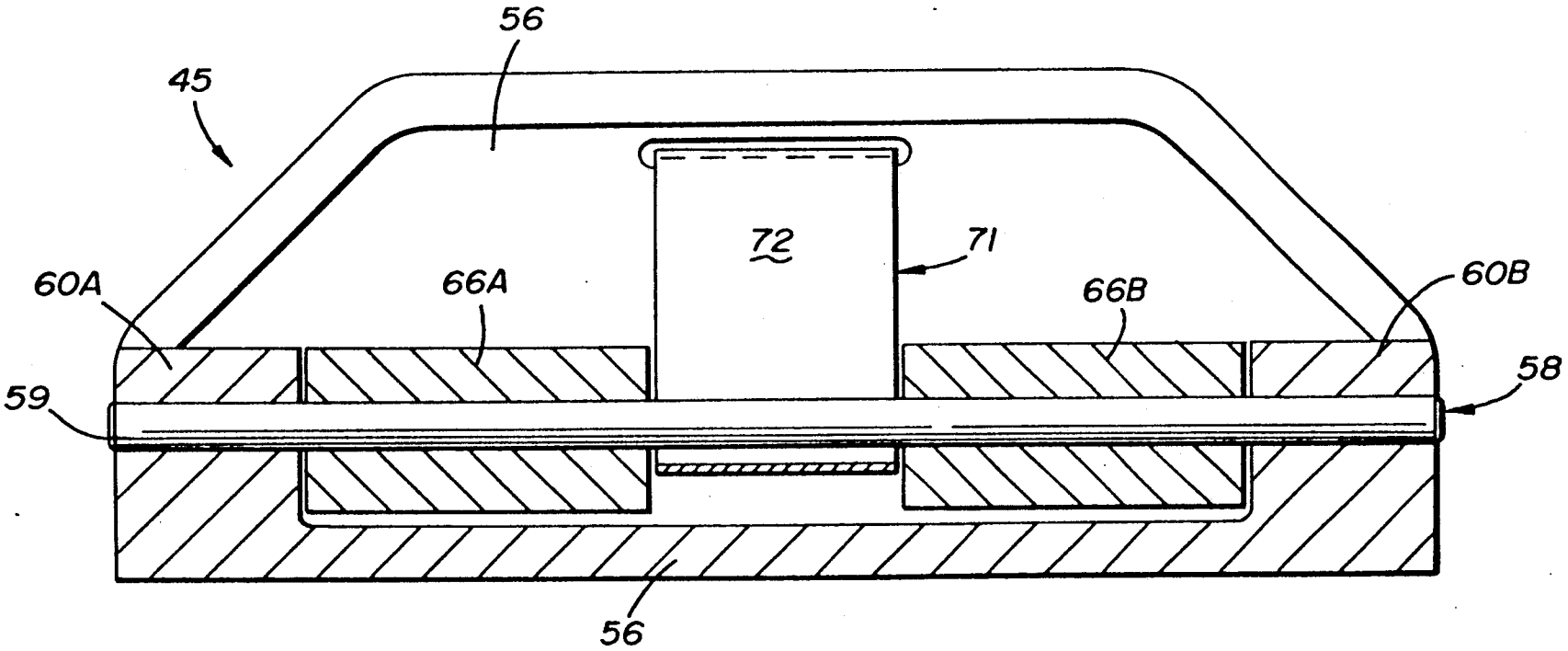

Subassembly 45 has a base plate 51 which may be secured to the frame element 14A on window unit 11A by virtue of a fastening means which may be in the nature of a flat head screw 52 which passes through a chamfered bore 53 in the base plate 51 to be received within a blind bore 54 that penetrates the transverse wall 15A. A catch block 55 is provided at the central portion (FIG. 1) on one end of the base plate 51 and a handle portion 56 extends outwardly from the opposite end of the base plate 51. A fulcrum 58 is provided at the intersection of the handle portion 56 with the base plate 51. The fulcrum 58 comprises a pivot support means in the nature of a roll pin 59 which extends between a pair of laterally spaced support blocks 60A and 60B (FIG. 6), and a first class release lever 65 is supported on the fulcrum 58. As depicted, the release lever 65 may have a journal portion 66 which receives the roll pin 59. The use of the well known roll pin 59 facilitates assembly of the release lever 65 between the laterally spaced support blocks 60A and 60B, and yet provides a secure means for pivotally mounting the release lever 65 to the base plate 51. The release lever 65 has a pair of arms 68 and 69 which extend outwardly from the journal portion 66. Arm 68 serves as the input arm, and arm 69 serves as the work arm of the release lever 65.

A foot 70 may extend perpendicularly outwardly from the work arm 69 to engage the base plate 51. The length of the foot 70, if employed, may be chosen in conformity to the distance at which the fulcrum 58 is displaced from the base plate 51 in order that the work arm 69 may respose in substantially parallel relation to the base plate 51 when the foot 70 engages the base plate 51.

Figure 4:
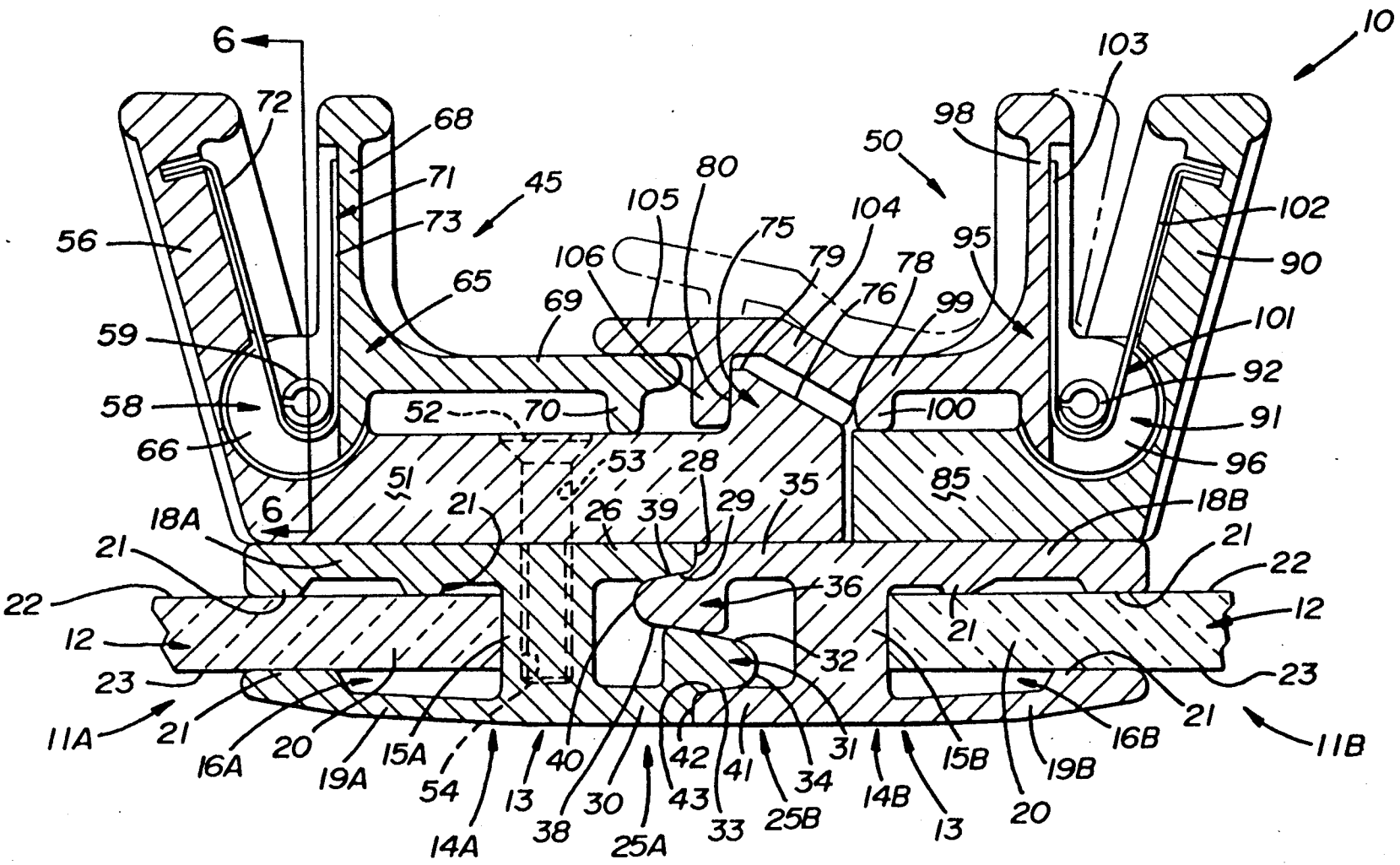
FIG. 4 is an enlarged cross section taken substantially along line 4—4 of FIG. 3 and including not only a representation of a typical, two unit slidable window assembly to which the subassemblies forming the latching mechanism are attached, but also a representation, in phantom, of the disposition of the components in the latching mechanism when one subassembly has been manipulated preparatory to opening the window unit to which that latch subassembly is attached.

A biasing means 71 is provided to urge the release lever 65 into the solid line disposition depicted in FIG. 4, with the foot 70 engaging the base plate 51. The biasing means 71 may, as depicted, comprise a generally U-shaped leaf spring which straddles the roll pin 59 and which has extending arms 72 and 73 which respectively engage the handle portion 56 of the base plate 51 and the input arm 68 of the release lever 65 to bias the release lever 65 clockwise about fulcrum 58, as viewed in FIGS. 4 and 5.

For convenience the handle portion 56 may extend outwardly from the base plate 51 to define an obtuse angle therebetween. The obtuse angle may typically be on the order of approximately 120°, as represented in the drawings. When the handle portion 56 is so disposed with respect to the base plate 51 it is convenient to have the input arm 68 and the work arm 69 of the release lever 65 disposed at substantially a right angle. The function achieved by having the arms 68 and 69 of the release lever 65 disposed at a lesser angle than that at which the handle 56 is disposed with respect to the base 51, as will be hereinafter more fully explained.

The catch block 75 which is presented from the central portion (FIG. 1), and at one end, of the base plate 51 presents a cam 76 (FIGS. 4 and 5) in the configuration of the planar surface which is inclined from the apex 78 of the latch block to the outermost face 79 of the catch block 75. The catch block 75 terminates in a locking surface 80 which extends perpendicularly outwardly from the base plate 51.

Subassembly 50 of the latch mechanism 10—which is mounted on the frame element 14B included in window unit 11B—has a base plate 85 which may be secured to that frame element 14B by virtue of a fastening means that may also be in the nature of a flat head screw 86 (FIG. 5) which passes through a chamfered bore 88 in the base plate 85 to be received within a blind bore 89 that penetrates the transverse wall 15B. A handle portion 90 extends outwardly from one end of the base plate 85. A fulcrum 91 is provided at the intersection of the handle portion 90 with the base plate 85. The fulcrum 91 comprises a pivot support means in the nature of a roll pin 92 which extends between a pair of laterally spaced support blocks 93 (FIG. 5) virtually identical to the support blocks 60 in subassembly 45, and a first class release lever 95 is supported on the fulcrum 91. The release lever 95 may have a journal portion 96 (similar to journal portion 66 on release lever 65) which receives the roll pin 92. The use of the well known roll pin 92 facilitates mounting the release lever 95 between the laterally spaced support blocks 93, and yet provides a secure means for pivotally mounting the release lever 95 to the base plate 85. The release lever 95 has a pair of arms 98 and 99 which extend outwardly from the journal portion 96. Arm 98 serves as the input arm, and arm 99 serves as the work arm of the release lever 95.

A foot 100 may extend perpendicularly outwardly from the work arm 99 to engage the base plate 85. The length of the foot 100, if employed, may be chosen in conformity to the distance at which the fulcrum 91 is displaced from the base plate 85 in order that at least that portion of the work arm 99 between the fulcrum 91 and the foot 100 may repose in substantially parallel relation to the base plate 85 when the foot 100 engages the base plate 85.

Figure 5:
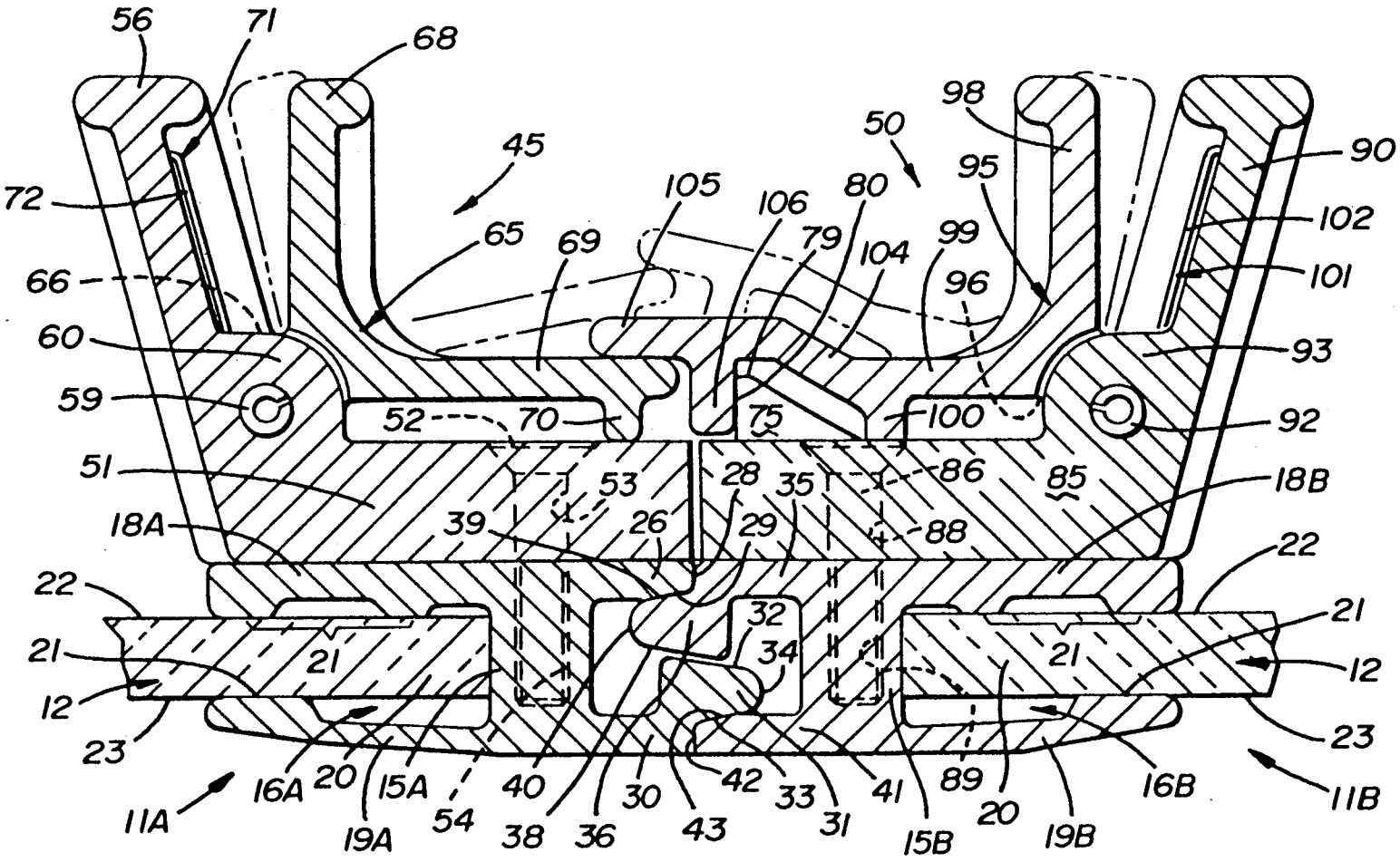
FIG. 5 is an enlarged cross section similar to FIG. 4 but taken substantially long line 5—5 of FIG. 3 and including a representation, in phantom, of the disposition of the components in the latching mechanism when the other latch subassembly has been manipulated preparatory to opening the window unit to which that subassembly is attached; and, FIG. 6 is a section taken substantially along line 6—6 of FIG. 4 to depict the handle portion on one latch subassembly in elevation.

A biasing means 101 is provided to urge the release lever 95 into the solid line disposition depicted in FIGS. 4 and 5 with the foot 100 engaging the base plate 85. The biasing means 101 may, as depicted, comprises a generally U-shaped leaf spring which straddles the roll pin 92 and which has extending arms 102 and 103 that respectively engage the handle portion 90 of the base plate 85 and the input arm 98 of the release lever 95 to bias the release lever 95 counterclockwise about fulcrum 91, as viewed in FIGS. 4 and 5.

For convenience the handle portion 90 may extend outwardly from the base plate 85 to define an obtuse angle therebetween. Here, too, the obtuse angle may typically be on the order of approximately 120°, as represented in the drawings. When the handle portion 90 is so disposed with respect to the base plate 85 it is convenient to have the input arm 98 and the work arm 99 of the release lever 95 disposed at substantially a right angle. The function achieved by having the arms of the release lever 95 disposed at a lesser angle than that at which the handle 90 is disposed with respect to the base 85 will also be hereinafter more fully explained.

Outwardly of the foot 100 the work arm 99 includes a transitional portion 104 that is inclined upwardly and merges with a throw projection 105. The throw projection 105 extends outwardly to overlie the catch block 75 presented from the first latch subassembly 45 and continues therebeyond to overlie a limited portion of the work arm 69 on the first release lever 65, also presented from the first latch subassembly 45. A latch arm 106 extends downwardly from the throw projection 105 to engage the locking surface 80 on the catch block 75 when the window units 11 are closed.

Operation

When the latch mechanism 10 is locked, which constitutes the disposition of the components heretofore described, the latch arm 106 engages the locking surface 80 on the catch block 75, which prevents the window units 11A and 11B from sliding apart—i.e.: opening. To unlock, or release, the latching mechanism 10, and allow either window unit 11A or 11B to be slid open, one grasps that latch subassembly 45 or 50 on that window unit 11A or 11B to be opened with one hand. That is, one simultaneously grasps either the handle portion 56 and the adjacent input arm 68 on the first subassembly 45 or the handle portion 90 and the adjacent input arm 98 on the second latch subassembly 50 between two fingers and squeezes. The squeezing action applied to either latch subassembly 45 or 50 unlocks the latch mechanism 10, and while holding either pair of components squeezed together one slides that window unit 11A or 11B open.

Should one elect to slide the window unit 11A open, the input arm 68 of the release lever 65 on the first latch subassembly 45 would be squeezed toward the handle portion 56, and that action would force the first release lever 45 to rotate counterclockwise, as depicted in phantom on FIG. 5, thereby forcing the work arm 69 upwardly against the throw projection 105 on the work arm 99 of the second release lever 95, and thereby rotating the second release lever 95 clockwise about the fulcrum 91, also as depicted on FIG. 5. The throw projection 105 extends sufficiently over the work arm 69 of the first release lever 65 so that the second release lever 95 may be rotated to that degree required to raise the latch arm 106 on the second release lever 95 sufficiently to clear the outermost face 79 on the catch block 75. This movement unlocks the latching mechanism 10 so that the window unit 11A can be slid open as part of the unlocking operation.

On the other hand, should one elect to slide the window unit 11B open, the input arm 98 on the release lever 95 of the second latch subassembly 50 would be squeezed toward the handle portion 90, and that action would force the second release lever 95 to rotate clockwise, as depicted in phantom on FIG. 4, thereby directly raising the latch arm 106 sufficiently to clear the outermost face 79 on the catch block 75. This movement unlocks the latch mechanism 10 so that the window unit 11B can be slid open as part of the unlocking operation.

Closing the window unit 11A against the window unit 11B automatically locks the latching mechanism 10. Specifically, as the window unit 11A is slid to the closed position the apex 78 of the catch block 75 passes beneath the latch arm 106 and permits the cam 76 on the catch block 75 to engage the latch arm 106 and thereby pivot the second release lever 95 against the action of the biasing means 101. The closing movement of the window unit 11A thus forces the latch arm 106 to climb the cam 76 and tranverse the outermost surface 79 on the catch block 75 until the latch arm 106 drops, also by the action of the biasing means 101, into engagement with the locking surface 80 on the catch block 75.

Similarly, closing the window unit 11B against the window unit 11A also automatically locks the latch mechanism 10—the only difference being that now the latch arm 106 is driven against the cam 76. In all other respects the locking operation is identical.

It should be noted that even though the subassembly 45 is secured to frame element 14A, the end of the base 51 from which the catch block 75 is presented overlies the extension wall 35 on frame element 14B when the latching mechanism 10 is locked. This overlapping enhances the stability of the closed window units 11A and 11B and ensures that the locking arrangement will be secure against unauthorized access from outside the closed window units 11. To facilitate achieving this overlap while closing the window units 11 it might be desirable to provide a rounded nose 108 on the extension wall 35 and/or a rounded nose 109 on the base 51 to accommodate the desired overlap without any possibility of the window units 11 sticking as the base 51 begins to slide over the extension arm 35 during closure of the window units 11.

As should now be apparent, the present invention not only teaches that a locking mechanism embodying the concepts of the present invention can be employed in conjunction with sliding members to facilitate the unlocking, opening, closing and locking thereof but can also accomplish the other objects of the invention.

I claim:

1. A latching mechanism for automatically locking, and unlocking, opposed first and second slidable members by manipulation of only that portion of the latching mechanism secured to the slidable member to be opened, said latching mechanism comprising:

first and second latch subassemblies;

said first latch subassembly adapted to be secured to said first slidable member;

said second latch subassembly adapted to be secured to said second slidable member;

a catch block extending from said first latch subassembly;

said catch block having a cam portion and a locking portion;

said first latch subassembly having a pivotally mounted first release lever;

said second latch subassembly having a pivotally mounted second release lever;

a latch arm projecting from said second release lever to engage said cam portion when said slidable members are closing and to engage said locking portion to lock said slidable members in their closed position;

means interacting between said first and second release levers so that pivotal movement of either release lever will release said latch arm from said locking portion.

2. A latching mechanism, as set forth in claim 1, wherein said first and second release levers each further comprise:

an input arm and a work arm;

said work arms incorporating the interacting means between said first and second release levers; and, said input arms being subject to manual manipulation.

3. A latching mechanism, as set forth in claim 2, wherein:

said first and second release levers are each pivotal between a locking position and an unlocking position;

each said release lever is a first class lever; and, a biasing means for urging said release levers into the locking position.

4. A latching mechanism, as set forth in claim 1, wherein:

said first and second release levers each have intersecting input and work arms, said input and work arms being substantially orthogonal, one with respect to the other;

each said release lever being pivotal about an independent fulcrum means acting at the intersection of said input and work arms.

5. A latching mechanism, as set forth in claim 4, wherein:

said first and second release levers are each pivotal between a locking position and an unlocking position; and, a biasing means for urging said release levers toward said locking position.

6. A latching mechanism, as set forth in claim 5, wherein each said latch subassembly further comprises:

a base; and, a handle portion extending outwardly from said base, said handle portion disposed at a substantially obtuse angle with respect to said base.

7. A latching mechanism, as set forth in claim 4, wherein:

a biasing means acts between a handle portion and said input arm on each said release lever.

8. A latching mechanism, as set forth in claim 7, wherein:

said catch block is presented from a base of said first latch subassembly; and, said latch arm is presented from said release lever of said second latch subassembly.

9. A latching mechanism in combination with two slidable members, said combination comprising:

first and second frame elements presented from said slidable members, said frame elements being disposed in opposition on said slidable members;

a sealing arrangement presented from each of said first and second frame elements;

a first latch subassembly secured to said first frame element;

a second latch subassembly secured to said second frame element;

a catch block extending from said first latch subassembly;

said catch block having a cam portion and a locking portion;

said first latch subassembly having a pivotally mounted first release lever;

said second latch subassembly having a pivotally mounted second release lever;

a latch arm projecting from said second release lever to engage said cam portion when said slidable members are closing and to engage said locking portion to lock said slidable members in their close position;

means interacting between said first and second release levers so that pivotal movement of either release lever will release said latch arm from said locking portion.

10. A combination, as set forth in claim 9, further comprising:

a sealing rib extended from each of said opposed frame elements;

a sealing face extended from each of said opposed frame elements;

said sealing ribs engaged with each other and said sealing faces when said latching mechanism is locked.

11. A combination, as set forth in claim 10, wherein:

said sealing ribs include a pair of compression walls;

one pair of said compression walls engaging each other and the second pair engaging said sealing faces when said latching mechanism is locked.

12. A combination, as set forth in claim 11, wherein:

each said sealing rib has a substantially triangular cross section;

said compression walls comprise two walls on each said sealing rib;

said compression walls are conjoined at an apex;

each said sealing face being inclined to engage with a compression wall on each of said sealing ribs; and, the other compression wall on each of said sealing ribs engaging with each other when said latching mechanism is locked.

13. A combination, as set forth in claim 12, wherein:

said catch block overlies said second frame element when said latching mechanism is locked.

14. A combination, as set forth in claim 13, wherein said first and second release levers each further comprise:

an input arm and a work arm;

said work arms incorporating the interacting means between said first and second release levers; and, said input arms being subject to manual manipulation.

15. A combination, as set forth in claim 14, wherein:

said first and second release levers are each pivotal between a locking position and an unlocking position;

each said release lever is a first class lever; and, a biasing means for urging said release levers into the locking position.

* * * * *